US009366011B2

(12) United States Patent
Kubota et al.

(10) Patent No.: US 9,366,011 B2
(45) Date of Patent: Jun. 14, 2016

(54) WORK MACHINE MANAGEMENT DEVICE

(71) Applicant: Hitachi Construction Machinery Co., Ltd., Bunkyo-ku, Tokyo (JP)

(72) Inventors: Kazuki Kubota, Hitachinaka (JP); Hiroyuki Adachi, Tsuchiura (JP); Shohei Kamiya, Ryugasaki (JP); Yutaka Watanabe, Tsuchiura (JP); Hiroshi Sazanami, Yokohama (JP); Masashi Shoji, Kasumigaura (JP)

(73) Assignee: Hitachi Corporation Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/396,836

(22) PCT Filed: Apr. 25, 2013

(86) PCT No.: PCT/JP2013/062227

§ 371 (c)(1),
(2) Date: Oct. 24, 2014

(87) PCT Pub. No.: WO2013/161946

PCT Pub. Date: Oct. 31, 2013

(65) Prior Publication Data

US 2015/0149047 A1 May 28, 2015

(30) Foreign Application Priority Data

Apr. 27, 2012 (JP) ..... 2012-102849

(51) Int. Cl.
*E02F 9/20* (2006.01)
*E02F 9/26* (2006.01)

(52) U.S. Cl.
CPC ..... *E02F 9/2025* (2013.01); *E02F 9/2054* (2013.01); *E02F 9/26* (2013.01); *E02F 9/262* (2013.01); *E02F 9/265* (2013.01); *E02F 9/267* (2013.01); *E02F 9/268* (2013.01)

(58) Field of Classification Search
CPC ..... E02F 9/26; E02F 5/145; E02F 9/967; E02F 9/2029; E02F 9/2253; E02F 3/16; E02F 9/268; E02F 9/264; E02F 9/262; G07C 5/0808; G07C 5/008; G07C 5/085; G07C 5/006; G07C 5/0841; G05B 19/4063; G05B 23/0272; G05B 2219/32224; G05B 2219/32226; G05B 23/0235; G05B 23/027; G05B 2219/24001; G05B 2219/24055
USPC ..... 701/50, 34.4, 31.4; 340/438, 685
See application file for complete search history.

(56) References Cited

U.S. PATENT DOCUMENTS 6,496,766 B1 * 12/2002 Bernold ..... B66C 15/065 212/276
6,728,619 B2 * 4/2004 Adachi ..... E02F 9/26 342/357.75

(Continued)

FOREIGN PATENT DOCUMENTS

EP 1 852 556 A1 11/2007
JP 2000-328610 A 11/2000

(Continued)

OTHER PUBLICATIONS

International Search Report dated Aug. 6, 2013 with English translation (five (5) pages).

(Continued)

*Primary Examiner* — Marthe Marc-Coleman
(74) *Attorney, Agent, or Firm* — Crowell & Moring LLP

(57) ABSTRACT

A work machine management device includes: a receiving unit that receives, from a work machine, sensor data indicating states of various sections of the work machine, and alarm data indicating that the work machine has determined that an abnormality has occurred in the work machine; and an operating level classifying unit that, based on the sensor data received by the receiving unit, classifies an operating state of the work machine as being any one of a plurality of predetermined operating levels.

10 Claims, 12 Drawing Sheets

(56) References Cited

U.S. PATENT DOCUMENTS

| | | | | |
|---|---|---|---|---|
| 2003/0023325 | A1* | 1/2003 | Adachi | E02F 9/26 700/9 |
| 2009/0259507 | A1 | 10/2009 | Miwa et al. | |

FOREIGN PATENT DOCUMENTS

| | | | | |
|---|---|---|---|---|
| JP | 2002-332666 | A | | 11/2002 |
| JP | 2003-85315 | A | | 3/2003 |
| JP | 2005-171527 | A | | 6/2005 |
| JP | 2005171527 | A | * | 6/2005 |
| JP | 2008-203941 | A | | 9/2008 |
| WO | WO 01/73224 | A1 | | 10/2001 |

OTHER PUBLICATIONS

European Search Report issued in counterpart European Application No. 13782116.1 dated Apr. 19, 2016 (eight (8) pages).

* cited by examiner

FIG.8

35

| No. | DATE AND TIME OF RECEPTION | WORK MACHINE ID | HOUR METER | HYDRAULIC OIL TEMPERATURE | ··· |
|---|---|---|---|---|---|
| 000001 | 2011/11/03 13:59:01 | XXXXXX | 131.2 | 46 | ··· |
| 000002 | 2011/11/03 13:59:05 | XXXXXX | 131.2 | 46 | ··· |
| 000003 | 2011/11/03 13:59:05 | YYYYYY | 95.4 | 45 | ··· |
| 000004 | 2011/11/03 14:34:51 | XXXXXX | 131.2 | 57 | ··· |
| ⋮ | ⋮ | ⋮ | ⋮ | ⋮ | ⋮ |

| OPERATING LEVEL | MODEL | S/N | ... | ... |
|---|---|---|---|---|
| ● | ×××−5B | 002105 | ... | ... |
| ◍ | ×××−5B | 002106 | ... | ... |
| ⊗ | △△△−N | 100012 | ... | ... |
| ○ | △△△−C | 9982 | ... | ... |
| ○ | □□□ | C608425 | ... | ... |

WORK MACHINE MANAGEMENT DEVICE

TECHNICAL FIELD

The present invention relates to a work machine management device.

BACKGROUND ART

A construction machine such as a hydraulic excavator or a crane or the like (i.e. a work machine) is made up of a plurality of components, and any one of those components can sometimes experience a failure. The details of the possible failures vary, and, while in the case of a simple failure the operator of the construction machine may be able to perform repairs, depending upon the details of the failure, it may not be possible for the operator to deal with that failure, in which case communication with service personnel of the manufacturer is required. For example, in Patent Document #1, a method for outputting failure handling method is described, in which the method of handling a failure that is indicated by the states of various parts of a work machine is calculated, and the calculated method for handling the failure is transmitted.

CITATION LIST

Patent Literature

Patent Document #1: International Publication No. WO 01/073224.

SUMMARY OF INVENTION

Technical Problem

Since, in the prior art, the way of handling a failure has been calculated on the basis of an alarm signal or a failure signal transmitted from a work machine, accordingly there has been the problem that it has not been possible to prevent a failure occurring before it actually happens.

Solution to Technical Problem

A work machine management device according to a first aspect of the present invention comprises: a receiving unit that receives, from a work machine, sensor data indicating states of various sections of the work machine, and alarm data indicating that the work machine has determined that an abnormality has occurred in the work machine; and an operating level classifying unit that, based on the sensor data received by the receiving unit, classifies an operating state of the work machine as being any one of a plurality of predetermined operating levels.

According to a second aspect of the present invention, it is preferable for the work machine management device according to the first aspect to further comprise a notification unit that, based on an operating level of the work machine as classified by the operating level classifying unit, notifies an operator of a course of action that is needed for bringing the operating state of the work machine to a normal state.

According to a third aspect of the present invention, the work machine management device according to the second aspect may further comprise: a transmission unit that transmits, to the work machine, a preparatory operation signal for causing the work machine to perform preparatory operation corresponding to the course of action notified by the notification unit.

According to a fourth aspect of the present invention, in the work machine management device according to the second or third aspect, it is preferable to further comprise: an event receiving unit that receives event data transmitted from the work machine in response to the course of action that has been implemented; wherein based on the event data received by the event receiving unit, the operating level classifying unit reclassifies the operating state of the work machine as being any one of the plurality of operating levels.

According to a fifth aspect of the present invention, in the work machine management device according to any one of the second to fourth aspects, it is preferable that for each operating level of the work machine as classified by the operating level classification unit, the notification unit selects at least one of a plurality of courses of action, and notifies the operator thereof.

According to a sixth aspect of the present invention, in the work machine management device according to any one of the first to fifth aspects, it is preferable to further comprise: a position receiving unit that receives a current position of the work machine; and a display unit that displays a map upon a display screen, and also displays a symbol indicating the operating level of the work machine as classified by the operating level classifying unit, superimposed upon the map at a position within the display screen that corresponds to the current position of the work machine as received by the position receiving unit.

Advantageous Effect of Invention

According to the present invention, it is possible to prevent the occurrence of a failure in the work machine before it actually happens.

BRIEF DESCRIPTION OF DRAWINGS

FIG. 8 is a figure showing an example of data stored in a database;

DESCRIPTION OF EMBODIMENTS (First Embodiment)

In the following, an embodiment in which the present invention is applied to a management system for hydraulic excavators will be explained.

Figure 1:
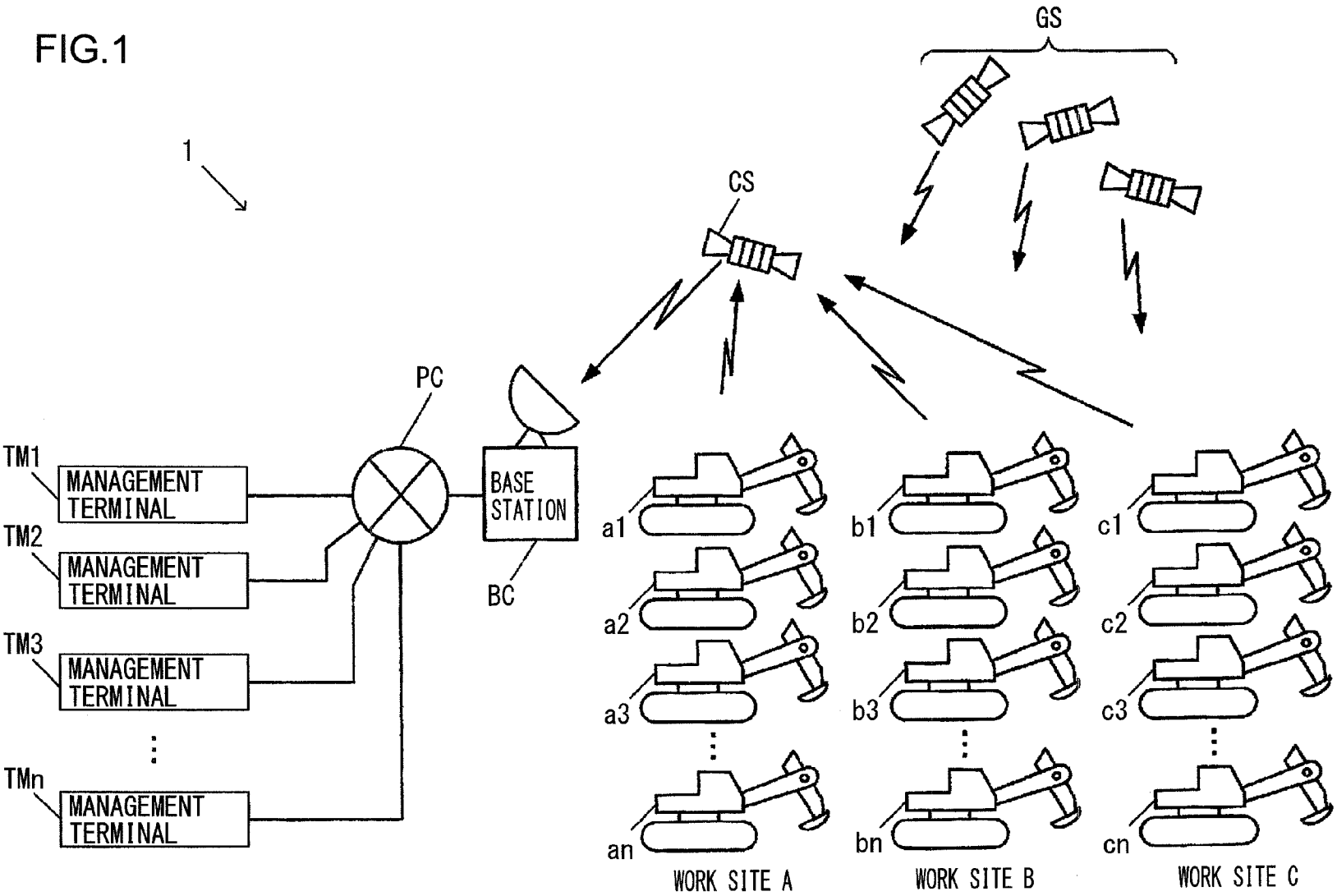
FIG. 1 is a figure explaining the schematics of a management system for hydraulic excavators according to a first embodiment of the present invention.

FIG. 1 is a figure explaining the schematics of a management system for hydraulic excavators according to a first embodiment of the present invention. The management system 1 of this embodiment is a system for managing pluralities of hydraulic excavators that are working in each of a plurality of work sites A, B, and C. Respectively, hydraulic excavators al through an are working in the site A, hydraulic excavators bl through bn are working in the site B, and hydraulic excavators cl through cn are working in the site C. The sites A, B, and C are not in the same workplace, but are geographically separated. Each of the hydraulic excavators is equipped with a GPS receiver, and is able to calculate its own current position by receiving signals from GPS satellites GS.

A base station BC is included in the management system 1. Transfer of data between the base station BC and the hydraulic excavators is made possible by wireless communication via a communication satellite CS. The base station BC is also connected to a plurality of management terminals TM1 through TMn via a network PC for general public use. While the details thereof will be described hereinafter, by transmitting predetermined display data to this plurality of management terminals TM1 through TMn, the base station BC is able to display the operating states and so on of the hydraulic excavators upon display screens of the management terminals TM1 through TMn. Moreover, when predetermined actuations (for example, depression of buttons or the like) are performed by operators on the management terminals TM1 through TMn, then actuation data corresponding to these actuations is transmitted to the base station BC from the management terminals TM1 through TMn.

In this embodiment, each of the hydraulic excavators detects the states of various of its own sections, and transmits state data specifying these detected states to the base station BC. In this embodiment, the state data includes data of three types. The first type of data is data specifying that some abnormality that affect the operation of the hydraulic excavator has been detected. The second type of data is data specifying that some actuation has been performed by the user of the hydraulic excavator, and specifying that implementation of processing corresponding to this actuation has been completed. And the third type of data is data specifying the operational state of the hydraulic excavator, such as, for example, sensor amounts detected by sensors provided to the hydraulic excavator, the current position of the hydraulic excavator as calculated by the GPS receiver, and so on.

Each of these three types of data is transmitted from the hydraulic excavator at an appropriate timing. For example, in the case of the first type of data, it is transmitted at the timing that the abnormality specified by that data is detected. Moreover, the second type of data is transmitted at the timing that the actuation and the processing specified by that data have been completed. And, in addition to the third type of data being transmitted together with data of the first or the second type when that data is transmitted, the third type of data may also be transmitted upon a predetermined cycle (for example at a period of a few minutes to a few hours), or may be transmitted in correspondence to change of the operational state corresponding to that data (for example, change of a sensor amount). In the following explanation, the first type of data is termed "alarm data", the second type of data is termed "event data", and information of the third type is termed "sensor data".

(Explanation of the Structure of the Hydraulic Excavators)

Figure 2:
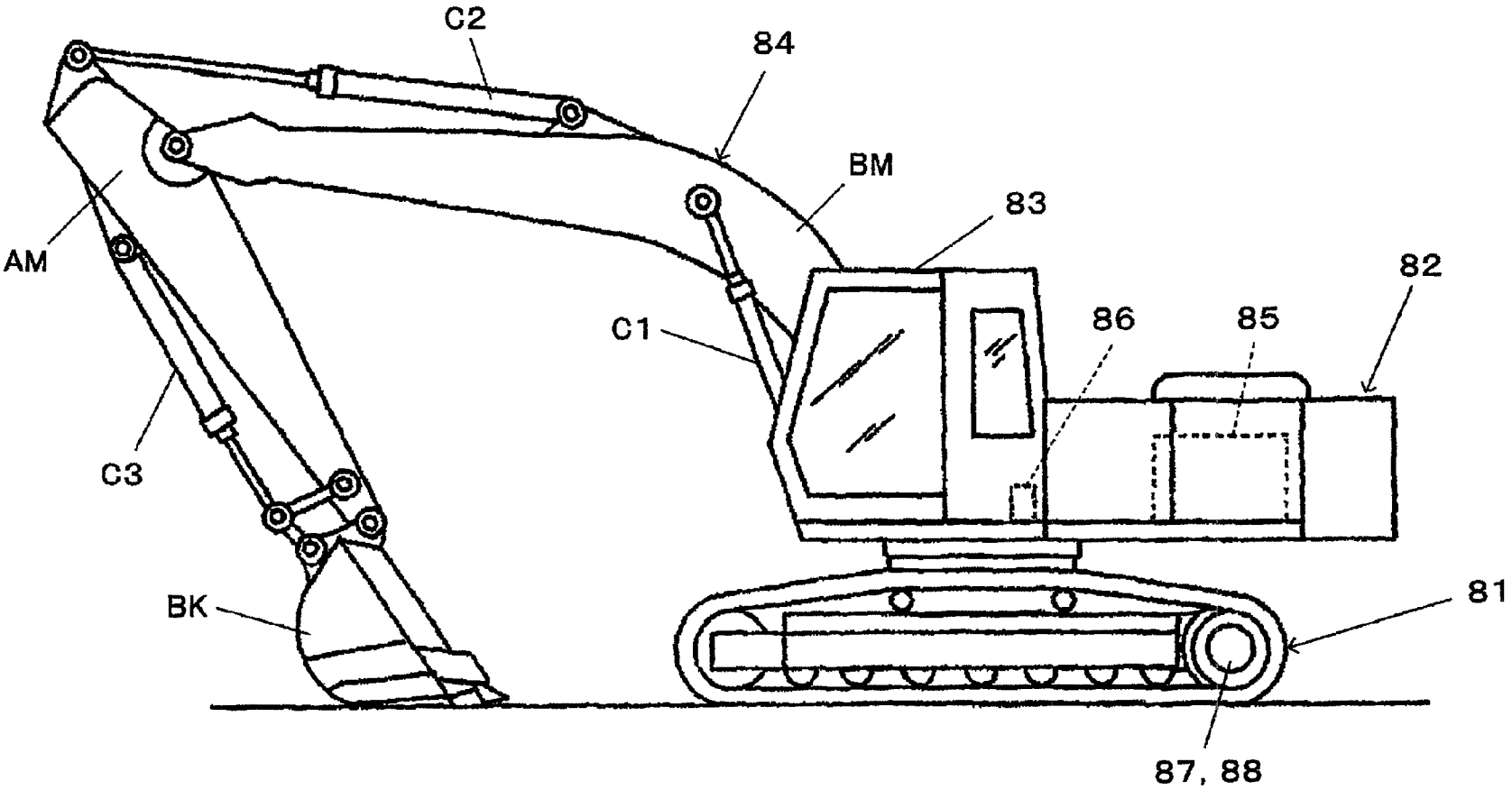
FIG. 2 is a schematic figure showing the structure of a hydraulic excavator.

FIG. 2 is a schematic figure showing the structure of one of the hydraulic excavators. The hydraulic excavator comprises a traveling body 81 and a revolving body 82 that is pivotally mounted on top of the traveling body 81. The revolving body 82 is provided with an operator's cab 83, a work device 84, an engine 85, and a revolving motor 86. The work device 84 comprises a boom BM that is rotatably attached to the main body of the revolving body 82, an arm AM that is rotatably connected to the boom BM, and an attachment that is rotatably connected to the arm AM, for example a bucket BK. The boom BM is raised and lowered by a boom cylinder C1, crowding and dumping operation of the arm AM is performed by an arm cylinder C2, and crowding and dumping operation of the bucket BK is performed by a bucket cylinder C3. Left and right hydraulic motors 87 and 88 for propulsion are provided to the traveling body 81.

Figure 3:
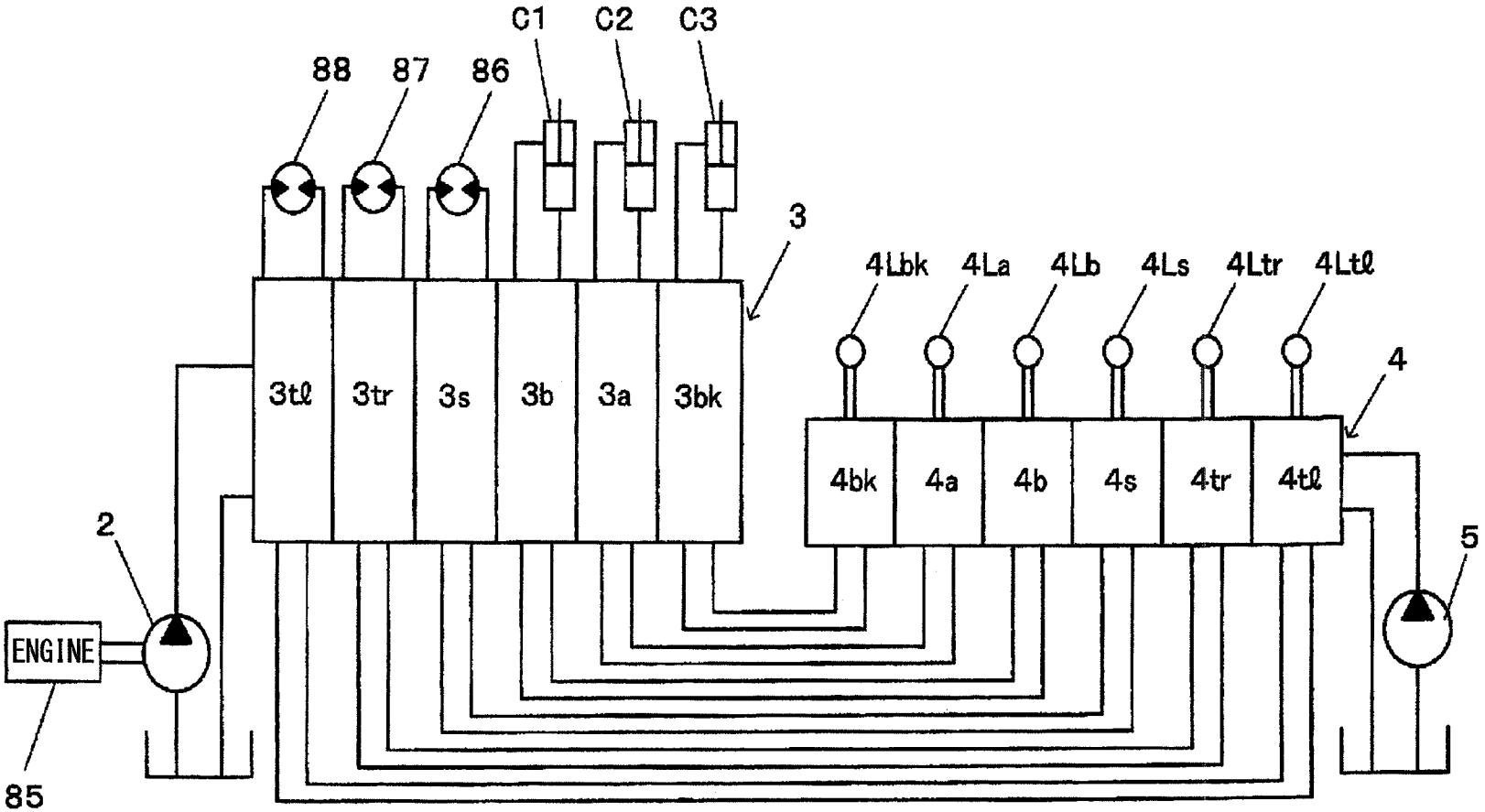
FIG. 3 is a schematic figure showing schematics of a hydraulic circuit of the hydraulic excavator.

FIG. 3 is a schematic figure showing the schematics of a hydraulic circuit of the hydraulic excavator. The engine 85 drives a hydraulic pump 2. The directions and the volumes of flows of the pressurized oil discharged from this hydraulic pump 2 are controlled by a plurality of control valves 3*s*, 3*tr*, 3*tl*, 3*b*, 3*a*, and 3*bk* to drive the hydraulic motor 86 for revolving, the left and right hydraulic motors 87 and 88 for propulsion, and the hydraulic cylinders C1, C2, and C3 described above. The plurality of control valves 3*s*, 3*tr*, 3*tl*, 3*b*, 3*a*, and 3*bk* operate by being changed over by pilot pressures that are supplied from a plurality of respectively corresponding pilot valves 4*s*, 4*tr*, 4*tl*, 4*b*, 4*a*, and 4*bk*. Pilot hydraulic pressure of a predetermined pressure value is supplied to the pilot valves 4*s*, 4*tr*, 4*tl*, 4*b*, 4*a*, and 4*bk* from a pilot hydraulic pump 5, and these pilot valves output pilot pressures corresponding to the amounts of actuation of actuation levers 4Ls, 4Ltr, 4Ltl, 4Lb, 4La, and 4Lbk. The plurality of control valves 3*s*, 3*tr*, 3*tl*, 3*b*, 3*a*, and 3*bk* are formed together in a single valve block. Moreover, the plurality of pilot valves 4*s*, 4*tr*, 4*tl*, 4*b*, 4*a*, and 4*bk* are also formed together in a single valve block.

Figure 4:
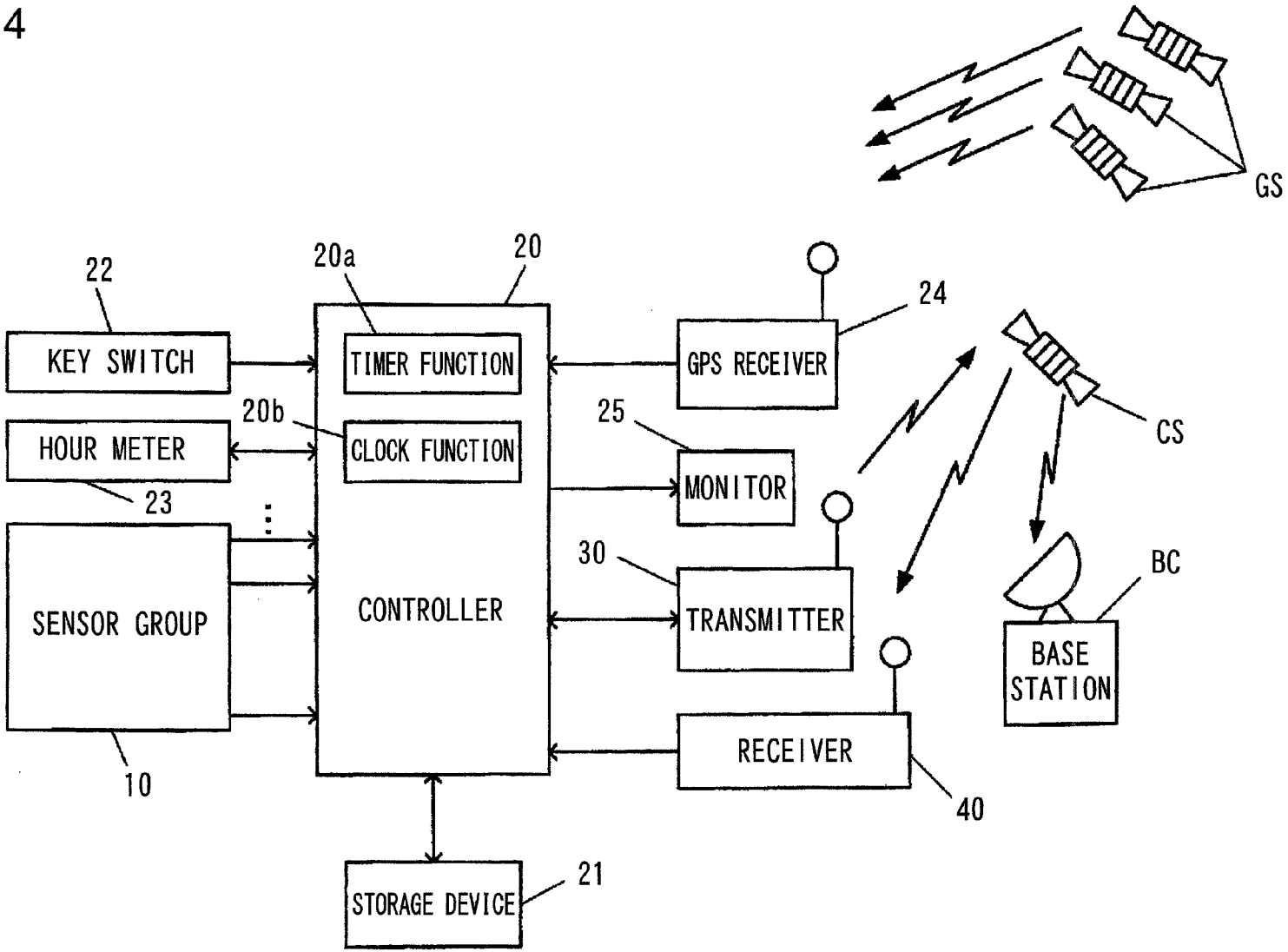
FIG. 4 is a block diagram of a control system for detecting the states of various portions of the hydraulic excavator, and for transmitting state data.

FIG. 4 is a block diagram of a control system for detecting the states of various portions of the hydraulic excavator, and for transmitting state data. The hydraulic excavator is equipped with a sensor group 10 including a plurality of sensors that detect the states of the various sections described above. And the state detection signals outputted from the sensor group 10 are read into a controller 20 at a predetermined timing. The controller 20 is equipped with a timer function 20*a* for accumulating the traveling working time, the revolving working time, and the front (i.e. excavation) working time. And, on the basis of the state detection signals that have thus been read in, the controller 20 calculates the traveling working time, the pivoting working time, and the front working time. These working periods that have thus been calculated are stored in a storage device 21. The hydraulic excavator also includes a key switch 22 for starting the engine 85, and an hour meter 23 for measuring the operating time period of the engine 85.

And the hydraulic excavator is equipped with a GPS receiver 24. This GPS receiver 24 receives GPS signals from GPS satellites GS, calculates the position of the hydraulic excavator on the basis of these GPS signals, and outputs this position to the controller 20. And a monitor 25 is provided at an operator's seat of the hydraulic excavator for displaying information of various types.

The controller 20 has a clock function 20*b*, and is able to recognize the time point that the key switch 22 is set to ON or set to OFF, the time point that the engine is started, and the time point that the engine is stopped. These time points are also stored in the storage device 21. The value measured by the hour meter 23 is also read into the controller 20 at a predetermined timing, and is stored in the storage device 21. Moreover, the traveling, revolving, and front working times stored in the storage device 21, and the time point that the key switch 22 is set to ON and so on, are transmitted via a transmitter 30 at predetermined timings. The radio waves transmitted from the transmitter 30 are received by the base station BC via the satellite CS. A receiver 40 is also connected to the controller 20. This receiver 40 receives signals such as a preparatory operation signal and so on sent from the base station BC via the communication satellite CS, and sends these signals to the controller 20.

Figure 5:
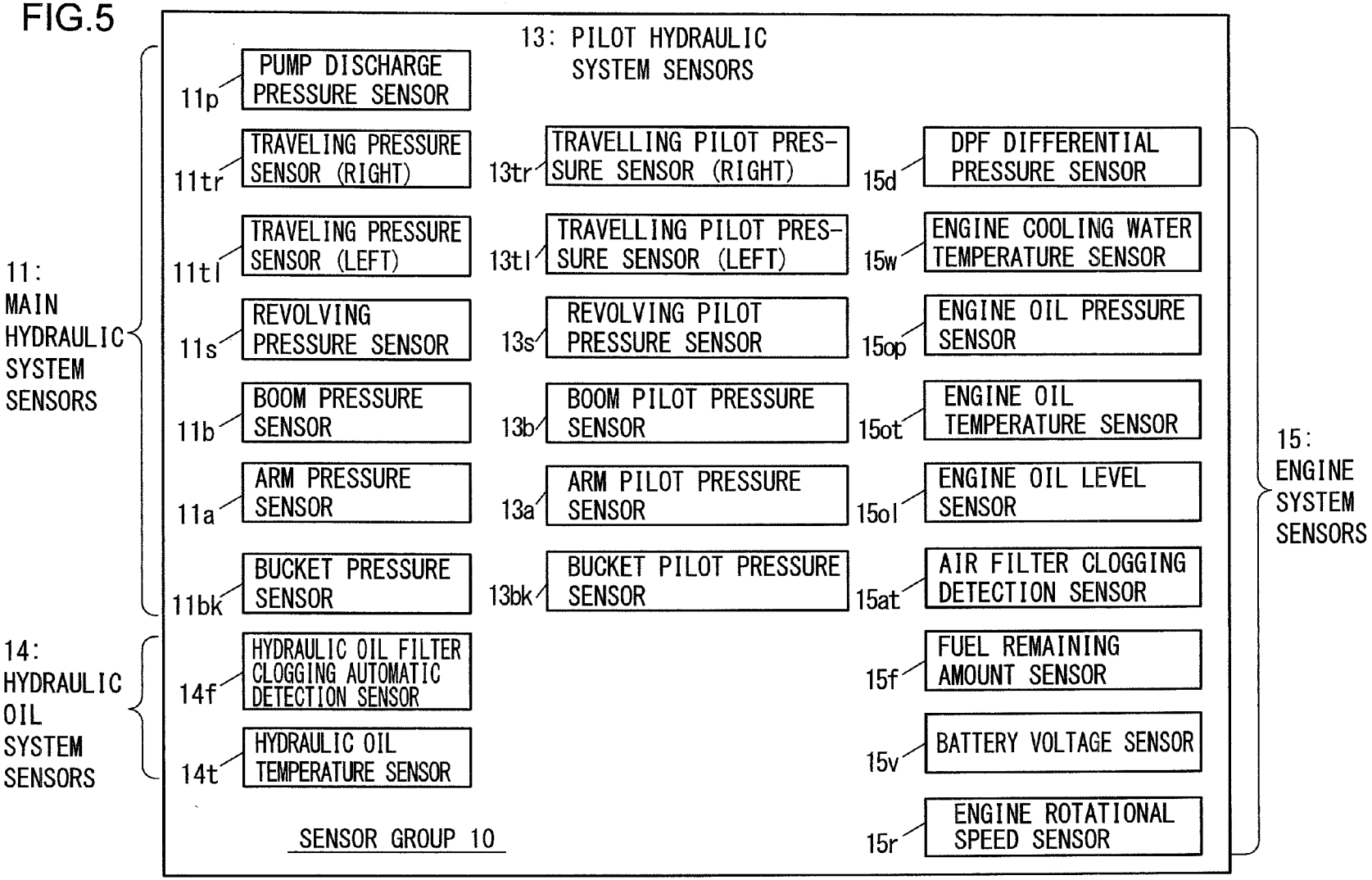
FIG. 5 is a figure showing sensors included in a sensor group.

FIG. 5 is a figure showing sensors included in the sensor group 10. The sensor group 10 comprises pressure sensors 11 for detecting the states of various pressures within a main hydraulic circuit system. In detail, the sensor group 10 comprises: a pressure sensor 11*p* that measures the discharge pressure of the hydraulic pump 2; pressure sensors 11*tr* and 11*tl* that measure the drive pressures at the travelling hydraulic motors 87 and 88; a pressure sensor 11*s* that measures the drive pressure at the revolving hydraulic motor 86; a pressure sensor 11*b* that measures the drive pressure at the boom hydraulic cylinder C1; a pressure sensor 11*a* that measures the drive pressure at the arm hydraulic cylinder C2; and a pressure sensor 11*bk* that measures the drive pressure at the bucket hydraulic cylinder C3.

The sensor group 10 also includes pressure sensors 13 for detecting the states of various pressures within a pilot hydraulic circuit system. In detail, the sensor group 10 includes: pressure sensors 13*tr* and 13*tl* that measure the pilot pressures Ptr and Ptl outputted from the travelling hydraulic pilot valves 4*tr* and 4*tl*; a pressure sensor 13*s* that measures the pilot pressure Ps outputted from the revolving hydraulic pilot valve 4*s*; a pressure sensor 13*b* that measures the pilot pressure Pb outputted from the boom hydraulic pilot valve 4*b*; a pressure sensor 13*a* that measures the pilot pressure Pa outputted from the arm hydraulic pilot valve 4*a*; and a pressure sensor 13*bk* that measures the pilot pressure Pbk outputted from the bucket hydraulic pilot valve 4*bk*.

The traveling working time is the time period obtained by accumulating the time period over which the pressure Ptr or the pressure Ptl detected by the travelling pilot pressure sensor 13*tr* or 13*tl* is greater than or equal to a predetermined value. The revolving working time is the time period obtained by accumulating the time period over which the pressure Ps detected by the revolving pilot pressure sensor 13*s* is greater than or equal to a predetermined value. And the front working time is the time period obtained by accumulating the time period over which any one of the pressures Pb, Pa, or Pbk detected by the pilot pressure sensors 13*b*, 13*a*, or 13*bk* for the boom, the arm, and the bucket is greater than or equal to a predetermined value.

The sensor group 10 also includes a pressure sensor 14*f* that detects clogging of a filter that is provided in a main hydraulic line, and a temperature sensor 14*t* that detects the temperature of the hydraulic oil that drives the hydraulic motors and the hydraulic cylinders. Moreover, the sensor group 10 also includes sensors 15 of various types that detect the state of the engine system. In detail, the sensor group 10 includes: a DPF differential pressure sensor 15*d* that detects the before/after pressure difference between the upstream side and the downstream side of a diesel particulate filter (DPF) that collects particulate matter (PM) included in the exhaust gas; a cooling water temperature sensor 15*w* that detects the temperature of the cooling water of the engine 85; an engine oil pressure sensor 15*op* that detects the pressure of the engine oil; an engine oil temperature sensor 15*ot* that detects the temperature of the engine oil; an engine oil level sensor 15*ol* that detects the level of the engine oil; a clogging sensor 15*at* that detects clogging of an air filter; a fuel remaining amount sensor 15*f* that measures the remaining amount of fuel; a battery voltage sensor 15*v* that detects the charged voltage of the battery; and a rotational speed sensor 15*r* that detects the engine rotational speed.

(Explanation of the Structure of the Base Station BC)

Figure 6:
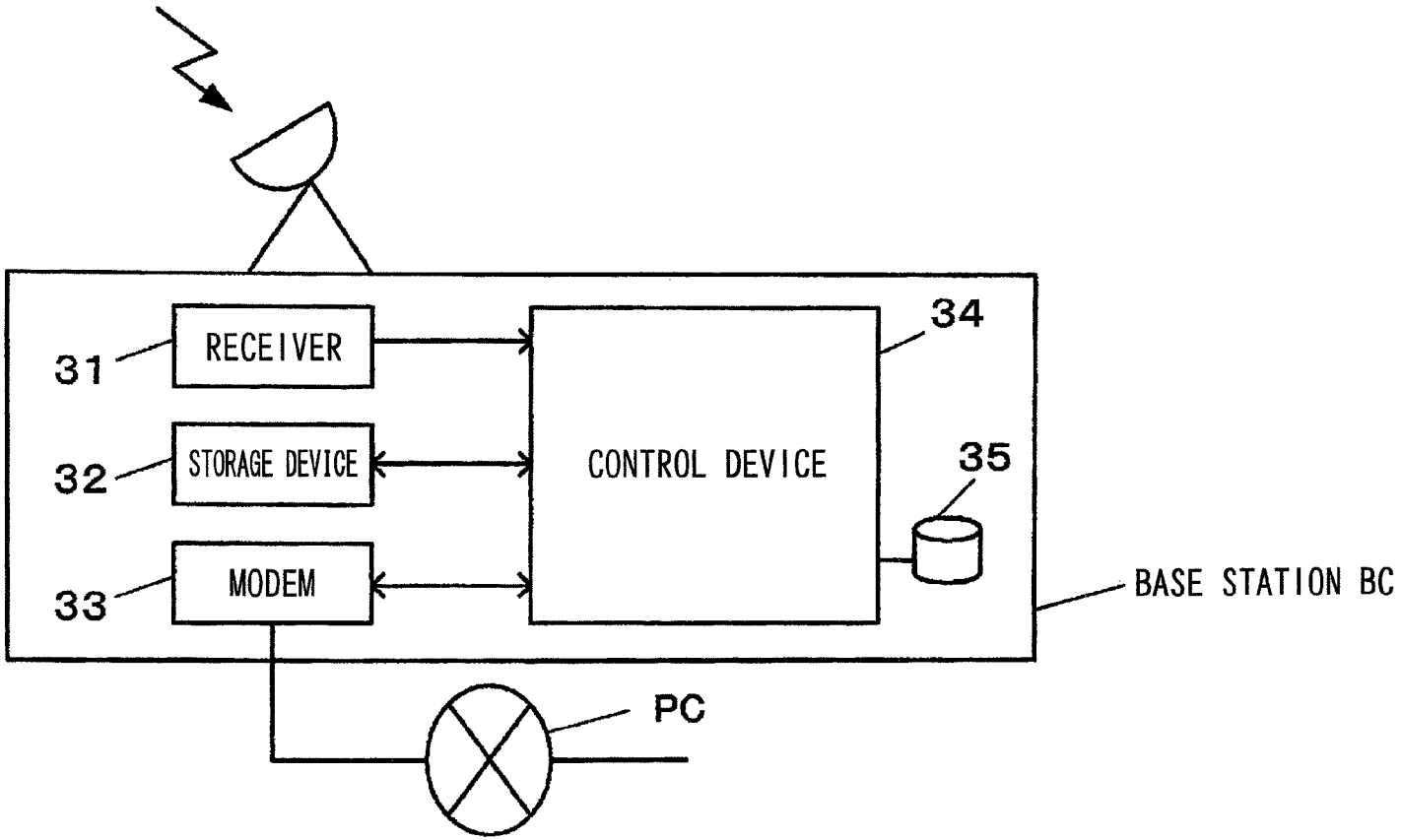
FIG. 6 is a block diagram showing the structure of a base station.

FIG. 6 is a block diagram showing the structure of the base station BC. The base station BC comprises a receiver 31 that receives wireless signals transmitted from the communication satellite CS and reconstructs the state data transmitted by the hydraulic excavator, a storage device 32 that temporarily stores the state data reconstructed by the receiver 31, a modem 33 that acts as a transmission unit for transmitting, via the general public circuit network PC, data that is to be transmitted to the management terminals, and a control device 34 that controls these various devices.

The base station BC is also provided with a data base 35 in which the state data transmitted from the hydraulic excavators is collectively stored. The control device 34 performs data shaping according to a predetermined format upon the state data that has temporarily been stored in the storage device 32, and stores the results in the data base 35. This data base 35 will be described in detail hereinafter.

(Explanation of the Structure of the Management Terminals TM)

Figure 7:
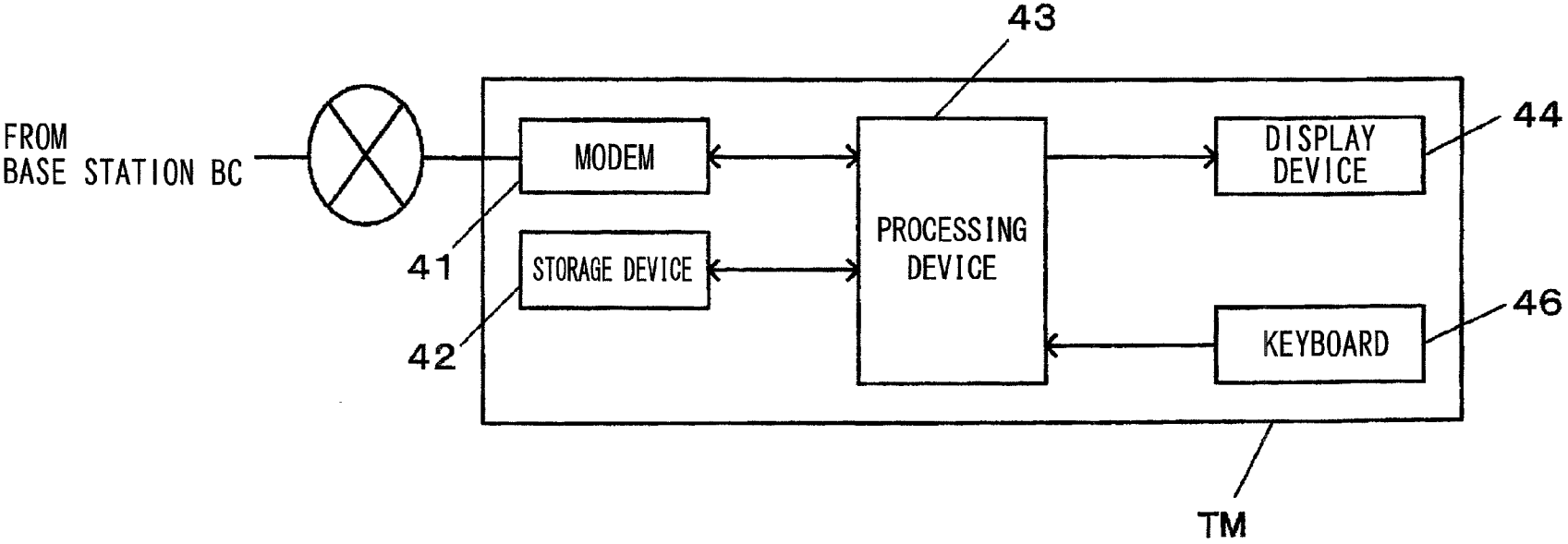
FIG. 7 is a block diagram showing the structure of a management terminal.

FIG. 7 is a block diagram showing the structure of one of the management terminals TM. This management terminal TM comprises a modem 41 that receives a signal sent from the base station BC via the general public circuit network PC, a storage device 42 that stores the signal received by the modem 41, a processing device 43 that performs calculation processing of various types, a display device 44 connected to the processing device 43, and a keyboard 46. On the basis of display data transmitted from the base station BC, the processing device 43 displays the states of the hydraulic excavators and their current positions and so on upon the display screen of the display device 44. Moreover, according to actuation performed upon an input device such as the keyboard 46 or the like, the processing device 43 transmits actuation data to the base station BC.

(Explanation of the Structure of the Data Base 35)

FIG. 8 is a figure showing an example of the data stored in the data base 35. The state data that has been transmitted from each of the hydraulic excavators is stored collectively in time series in this data base 35, with, appended thereto, sequential numbers ("No.") for identifying the state data, work machine IDs for identifying the hydraulic excavators, and the dates and times of reception (or the dates and times of transmission) of the state data.

Upon receipt of state data from one of the hydraulic excavators, the control device 34 of the base station BC stores (adds) this state data into the data base 35 with the information described above appended thereto. And the control device 34 classifies the operating levels by referring to the data base 35 during operating level classification processing that will be described hereinafter, generates display data on the basis of the state data stored in the data base 35, and transmits this display data to the management terminals TM.

(Explanation of the Classification by the Base Station BC of the Operating Levels of the Hydraulic Excavators)

Whenever state data is transmitted from one of the hydraulic excavators, the base station BC of this embodiment classifies the hydraulic excavator as operating on one of four levels, on the basis of the transmitted state data and past state data stored in the data base 35 and so on. In the following, these four operating levels will be explained.

The first level is a level meaning that no factor indicating a fault in the operation of this hydraulic excavator has been found. For a hydraulic excavator that has been classified as operating on this first level, the operator of the management terminal TM or the user of the hydraulic excavator is not required to perform any special action.

The second level is a level meaning that a symptom has been observed of a fault with this hydraulic excavator. While, for a hydraulic excavator that has been classified as operating on this second level, the operator of the management terminal TM or the user of the hydraulic excavator is not required to perform any special action urgently, it is necessary for him/her to be vigilant for subsequent change of the situation.

The third level is a level meaning that some problem linked to a serious fault is occurring with this hydraulic excavator. For a hydraulic excavator that has been classified as operating on this third level, it is necessary for the operator of the management terminal TM to execute some special countermeasure, such as, for example, commanding the user of the hydraulic excavator to perform some specific action, or transmitting to the hydraulic excavator a preparatory operation signal that will be described hereinafter, or the like.

The fourth level is a level meaning that communication between the hydraulic excavator and the base station BC is interrupted, due to some reason such as the environment in the neighborhood of the hydraulic excavator or a failure of the transmitter 30 or the like. As an exception, the base station BC classifies the operating level into the fourth level at a timing other than when state data is transmitted from the hydraulic excavator. In the case of, for example, a hydraulic excavator for which state data has not been transmitted over a fixed time period or longer, the base station BC classifies this hydraulic shovel as operating on the fourth level.

(Explanation of the Display Screens of the Management Terminals TM)

Figure 9:
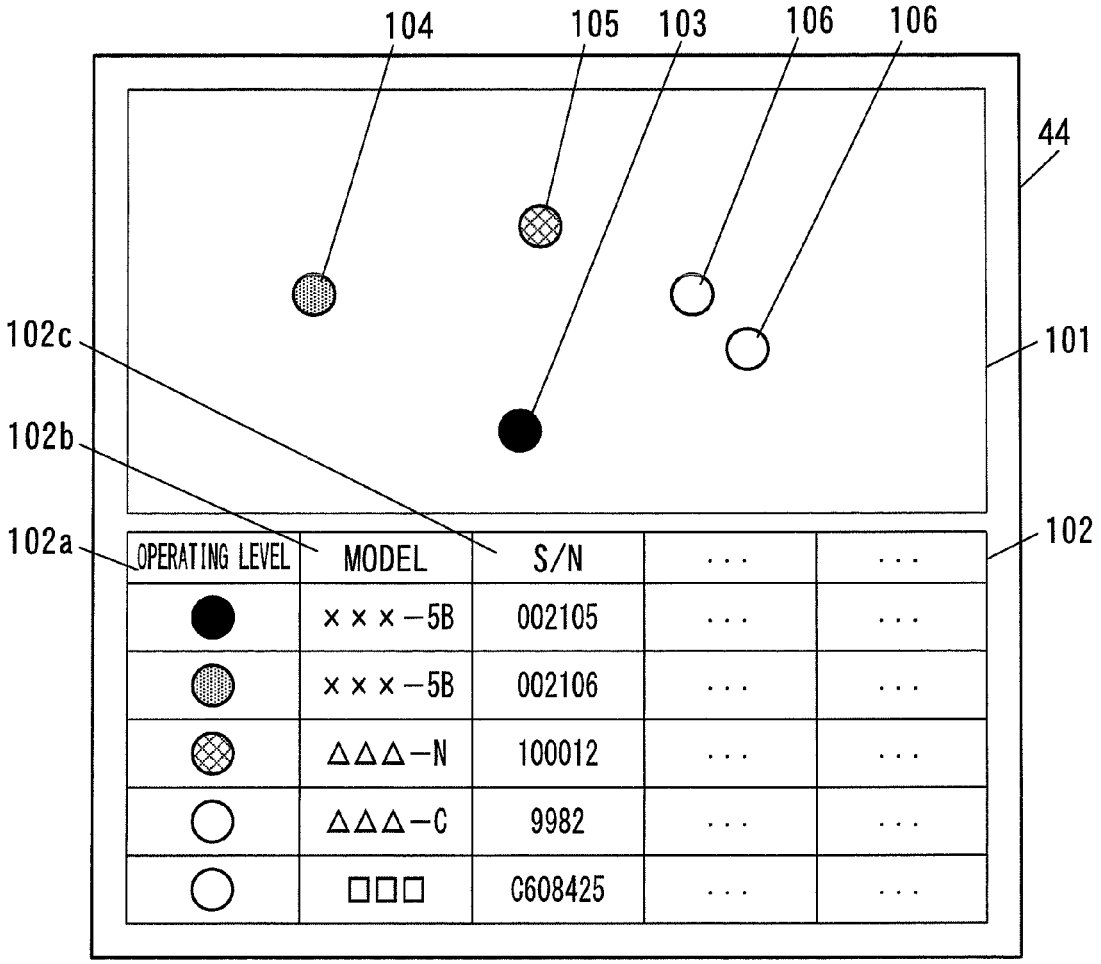
FIG. 9 is a figure showing an example of a display screen displayed upon a display device of the management terminal.

FIG. 9 is a figure showing an example of a display screen displayed upon the display device 44 of one of the management terminals TM. A map 101 and a work machine list 102 are displayed upon the display device 44. By actuating the keyboard 46 or the like, the operator of the management terminal TM is able to change the scale of the map 101 and to cause it to scroll. On the basis of display data received from the base station BC, the processing device 43 displays symbols 103 through 106 superimposed upon the map 101 for representing the hydraulic excavators in positions corresponding to the current positions of those hydraulic excavators. In other words, by looking at the map 101, the operator is able to ascertain intuitively how many of the hydraulic excavators are operating in what sites.

The symbols 103 through 106 for the hydraulic excavators are displayed in different ways according to the operating levels on which the hydraulic excavators are operating. In this embodiment, each of the symbols 103 through 106 is displayed in a color that corresponds to the operating level of the corresponding hydraulic excavator. In other words, the operating level of each of the hydraulic excavators is shown by a symbol whose colors vary, so that, for example, the symbol 106 that denotes a hydraulic excavator whose operating level is the first level is shown in green, the symbol 105 that denotes a hydraulic excavator whose operating level is the second level is shown in yellow, the symbol 104 that denotes a hydraulic excavator whose operating level is the third level is shown in red, and the symbol 103 that denotes a hydraulic excavator whose operating level is the fourth level is shown in black.

The work machine list 102 is displayed under the map 101, this being a list of the hydraulic excavators that are included in that map 101. For each of the hydraulic excavators, a list of attributes of that hydraulic excavator is displayed in the work machine list 102, such as its operating level 102*a*, its model number 102*b*, its serial number 102*c* and so on. The operator of the management terminal TM is able to perform actuation with the keyboard 46 or the like in order to select any one of the hydraulic excavators. For example, when selection actuation is performed by clicking with a mouse or the like upon the symbol that indicates the operating level, then the processing device 43 changes over the details of the display upon the display device 44 to a screen that displays information related to the hydraulic excavator that has become the subject of this selection actuation. Upon the screen after changeover, in addition to the state of that hydraulic excavator, the reason for the hydraulic excavator having been classified as operating at its current operating level is displayed. Moreover, if the operating level is the second level or the third level, then, furthermore, the procedure required for the countermeasure that is to be executed for that hydraulic excavator is displayed.

The details of the above display are all based upon display data transmitted from the base station BC. In other words, the processing device 43 of the management terminal TM displays predetermined details upon the display device 44 on the basis of display data that has been transmitted from the base station BC.

(Concrete Examples of Operating Level Classification by the Base Station BC)

Next, how the base station BC performs classification into the various operating levels will be explained by using (1) an example of a regeneration mechanism for the DPF, and (2) an example of a cooling mechanism for the engine. It should be understood that, actually, the base station BC classifies the operating levels of the hydraulic excavators by also using the outputs of various sensors other than these.

(1) The DPF Regeneration Mechanism

The engine 85 that is provided to the hydraulic excavator of this embodiment is equipped with the DPF in its passage for discharge of the exhaust gases. And the DPF differential pressure sensor 15*d* detects the difference in pressures before and after this DPF. This pressure difference indicates the amount of PM deposited on the DPF (i.e. the degree of clogging of the DPF). The PM deposition amount that has been detected is transmitted to the base station BC as sensor data, each time change thereof by a predetermined value or greater takes place.

The controller 20 of the hydraulic excavator executes DPF regeneration control in order to prevent the DPF from becoming clogged, which would be undesirable. Regeneration control is, for example, control in which the temperature of the exhaust that passes through the DPF is elevated by performing post-injection or by raising the rotational speed of the engine, so that the PM is combusted. The controller 20 is capable of performing two types of regeneration control: periodic regeneration control, that is executed automatically each time a predetermined time period elapses; and manual regeneration control, that is executed according to manual actuation by the operator of the hydraulic excavator. During regeneration control some influence may be exerted upon the operation of the hydraulic excavator, such as, for example, deterioration of the fuel consumption, or reduction of the output of the engine 85. During periodic regeneration control, the controller 20 performs control so that this type of influence is reduced, although the beneficial effect due to regeneration of the DPF is relatively low. Moreover during manual regeneration control, although control is performed so that the beneficial effect due to regeneration is relatively greater, at this time a greater influence is exerted upon the operation of the hydraulic excavator than during periodic regeneration control; for example, it may become impossible for the hydraulic excavator to perform the work for which it is to be employed, or a limit may be imposed upon the details of that work, or the like.

When the execution of regeneration control has been completed, the controller 20 transmits event data specifying that execution of regeneration control has been completed, and also transmits sensor data specifying the PM deposition amount, as detected by the DPF differential pressure sensor 15*d* after the completion of regeneration. And if the PM deposition amount after the completion of periodic regeneration control is greater than or equal to a predetermined threshold value, in other words if the PM deposition amount has not been reduced sufficiently even though periodic regeneration control has been executed, then the base station BC classifies the operating level of this hydraulic excavator as being the third level. And the base station BC transmits to the management terminal TM display data including a predetermined procedure for eliminating this clogging of the DPF, in correspondence with the ID or the like by which this hydraulic excavator is identified. Due to this, a red symbol 104 comes to be displayed upon the display device 44 of the management terminal TM at the position of this hydraulic excavator, indicating the third level.

By visually observing this red symbol 104, the operator of the management terminal TM can recognize that it is necessary to institute some countermeasure in connection with this hydraulic excavator. And he/she then performs actuation for selecting this hydraulic excavator. At this time, on the basis of display data transmitted from the base station BC, a predetermined procedure for eliminating clogging of the DPF is displayed upon the display device 44. For example, a display such as "Please request the operator of the hydraulic excavator to perform manual regeneration" may be provided. And, in response to this display, the operator of the management terminal TM requests the operator of the hydraulic excavator to perform manual regeneration. Then the operator of the hydraulic excavator causes the controller 20 of the hydraulic excavator to perform manual regeneration by performing actuation such as depression of a manual regeneration button or the like.

In this manual regeneration control, exhaust is fed through the DPF at a higher temperature than in the case of the periodic regeneration control described above, so that there is a possibility of eliminating clogging of the DPF that could not be eliminated by the periodic regeneration control, due to PM being combusted that was not combusted during the previous periodic regeneration control. When this manual regeneration control has been completed, the controller 20 of the hydraulic excavator transmits to the base station BC event data that indicates that manual regeneration control has been completed, and also transmits sensor data specifying the PM deposition amount after manual regeneration control has been completed. And the base station BC re-classifies the operating level of this hydraulic excavator based on this sensor data. For example, if the PM deposition amount has been reduced sufficiently, then the operating level is re-classified to the first level, and the symbol upon the management terminal TM is changed to a symbol 106 in green color. On the other hand if, even though manual regeneration control has been performed the PM deposition amount has not dropped to lower than a predetermined threshold value, then this hydraulic excavator is reclassified to the third level. At this time, while the red symbol 104 that indicates the third level continues to be displayed upon the display device 44 of the management terminal TM, when actuation is performed to select this hydraulic excavator, the procedure that is displayed is different from the previous one. For example, a command may be displayed to go to the work site and to perform a failure diagnosis, or a command may be displayed to investigate whether or not the DPF differential pressure sensor 15*d* itself may be in failure.

It should be understood that, along with the operating level of each of the hydraulic excavators, a date and time that specify the time point that the operating level of each hydraulic excavator was classified are displayed upon the display device 44. Accordingly, even in the case of a hydraulic excavator that the base station BC has again classified to be on the third level, still the operator of the management terminal TM is able to recognize that it has had a change of state from when it was previously classified on the third level. Moreover, it would also be acceptable to arrange for the order of listing of the work machines as displayed in the work machine list 102 to be in the order of their operating level classification dates and times (descending order). By doing this, the work machine for which the change in operating state has been the most recent is listed higher up in the work machine list 102.

In this manner, the base station BC classifies the operating level of a hydraulic excavator by determining, on the basis of the state data transmitted from the hydraulic excavator, a symptom of an abnormality that cannot be determined by the hydraulic excavator by itself. And the base station BC prevents, even before it happens, a problem that may become an obstacle to the operation of the hydraulic excavator, by notifying to the operator this operating level and a procedure for the countermeasures that are to be implemented. To put this in another manner, it is possible to advise the operator of the hydraulic excavator to implement a handling procedure by which he/she is able himself/herself to solve the problem, before the state in which alarm data is transmitted and repair and/or inspection or the like by service personnel becomes necessary. And, only when the problem cannot be solved by implementing this handling procedure, a procedure for repair or inspection or the like will be provided. Thus the operator of the management terminal TM is enabled to perform advance preparation for repairs and inspection by service personnel in a smooth manner, since he/she is able to obtain information as to what type of problem is present in which section of the working machine.

(2) The Engine Cooling Mechanism

Each of the hydraulic excavators of this embodiment detects the temperature of its engine cooling water with its engine cooling water temperature sensor 15*w*. Moreover, the temperature of the hydraulic oil that drives the hydraulic motors and the hydraulic cylinders is detected with the hydraulic oil temperature sensor 14*t*. Furthermore, the temperature of the external air in the location where the hydraulic excavator is operating is detected with an external air temperature sensor not shown in the figures. In the following, the classification of operating level by using the data outputted by these sensors will be explained.

This sensor data for the hydraulic excavator that is thus detected is periodically transmitted to the base station BC by the controller 20 of the hydraulic excavator. And the base station BC calculates the average of the engine cooling water temperatures within, for example, the most recent one-hour period, based on the engine cooling water temperatures that have been transmitted from the hydraulic excavators. And the averages of the working hydraulic fluid temperatures and the external air temperatures are also calculated in a similar manner.

For one of the hydraulic excavators, the base station BC classifies the operating level of this hydraulic excavator on the basis of the most recent temperatures transmitted from this hydraulic excavator (i.e. the temperature of its engine cooling water, the temperature of its hydraulic oil, and its external air temperature), the average temperatures described above, temperatures that have been transmitted from this hydraulic excavator in the past, and so on. And a procedure for instituting any countermeasure for this hydraulic excavator that is to be executed is displayed upon the display device 44 by transmitting display data to the management terminal TM. In the following, an example of the operating level classification will be presented.

(2-1) During Normal Conditions

Since it is considered that no particular problem is present for the cooling system of the engine of one of the hydraulic excavators if, for both of the cooling water temperature and the hydraulic oil temperature that have been detected from the one hydraulic excavator, the difference from the average value of the corresponding temperatures that have been detected from all the hydraulic excavators is within a fixed range, accordingly in this case the base station BC classifies the one hydraulic excavator as operating on the first level.

(2-2) When a First Threshold Value is Exceeded

If both the cooling water temperature and the hydraulic oil temperature that have been detected for one of the hydraulic excavators are somewhat higher than the average values of those temperatures that have been detected over all the hydraulic excavators (i.e. if their differences therefrom are both greater than a first threshold value), then it is considered that the radiator of that hydraulic excavator is somewhat clogged. Thus, the base station BC classifies that hydraulic excavator as operating on the second level. At this time, a display is provided on the display device 44, advising the operator to monitor subsequent changes closely.

(2-3) when a Second Threshold Value that is Larger than the First Threshold Value is Exceeded If both the cooling water temperature and the hydraulic oil temperature that have been detected for one of the hydraulic excavators are very much higher than the average values of those temperatures that have been detected over all the hydraulic excavators (i.e. if their differences therefrom are both greater than a second threshold value that is larger than the first threshold value), then it is considered that the radiator of that hydraulic excavator is seriously clogged. Thus the base station BC classifies that hydraulic excavator as operating on the third level, since it is considered that some serious failure will occur if this situation is neglected. At this time, a display is provided on the display device 44, advising the operator to inspect the radiator.

(2-4) When Only the Cooling Water Temperature is High

If, for one of the hydraulic excavators, even though there is no great difference between the temperature of its hydraulic oil that has been detected from the one hydraulic excavator and the average of the temperatures, still the cooling water temperature that has been detected for the same hydraulic excavator is sufficiently higher than the average temperature (i.e. if its difference therefrom is greater than the second threshold value), then it is considered that some abnormality is occurring with the cooling system of the engine of that hydraulic excavator. Thus the base station BC classifies that hydraulic shovel as operating on the third level. At this time, a display is provided on the display device 44, advising the operator to inspect the cooling system of the engine.

(2-5) When Alarm Data has been Transmitted

With the hydraulic excavator of this embodiment, it is arranged for alarm data indicating an overheating warning to be transmitted when the cooling water temperature becomes equal to or greater than a fixed value. If alarm data that indicates an overheating warning is being transmitted from one of the hydraulic excavators, even though there is not much difference between both the cooling water temperature and the hydraulic oil temperature that have been detected for that hydraulic excavator and the average temperatures, then the base station BC determines that an abnormality is occurring in the electrical system of that hydraulic excavator. And the base station BC classifies this hydraulic excavator as being on the third level. At this time, a display is provided on the display device 44 advising the operator to inspect the electrical system of this hydraulic excavator.

As described above, the base station BC classifies the operating level of one of the hydraulic excavators by determining a symptom of an abnormality that cannot be determined by that hydraulic excavator by itself, not only on the basis of the state data that has been transmitted from that hydraulic excavator, but also on the basis of the state data that has been transmitted from the other hydraulic excavators (for example, by comparing the temperatures that have been detected for that hydraulic excavator with the temperatures that have been detected for the other hydraulic excavators). And, by notifying the operator of this operating level and of a procedure for instituting a countermeasure that must be implemented, a problem that might cause an obstacle to the operation of the hydraulic excavator is prevented even before it occurs. Moreover, at this time, different operational procedures may be displayed upon the management terminal TM, even in the case of hydraulic excavators that are all classified as being upon the same third level. This is because, even though the hydraulic excavators are all classified as being upon the same third level, the types of the problems that are considered to be occurring based on which the hydraulic excavators are classified upon the third level are different, so that the countermeasures that need to be implemented in order to eliminate those problems are also different.

Figure 10:
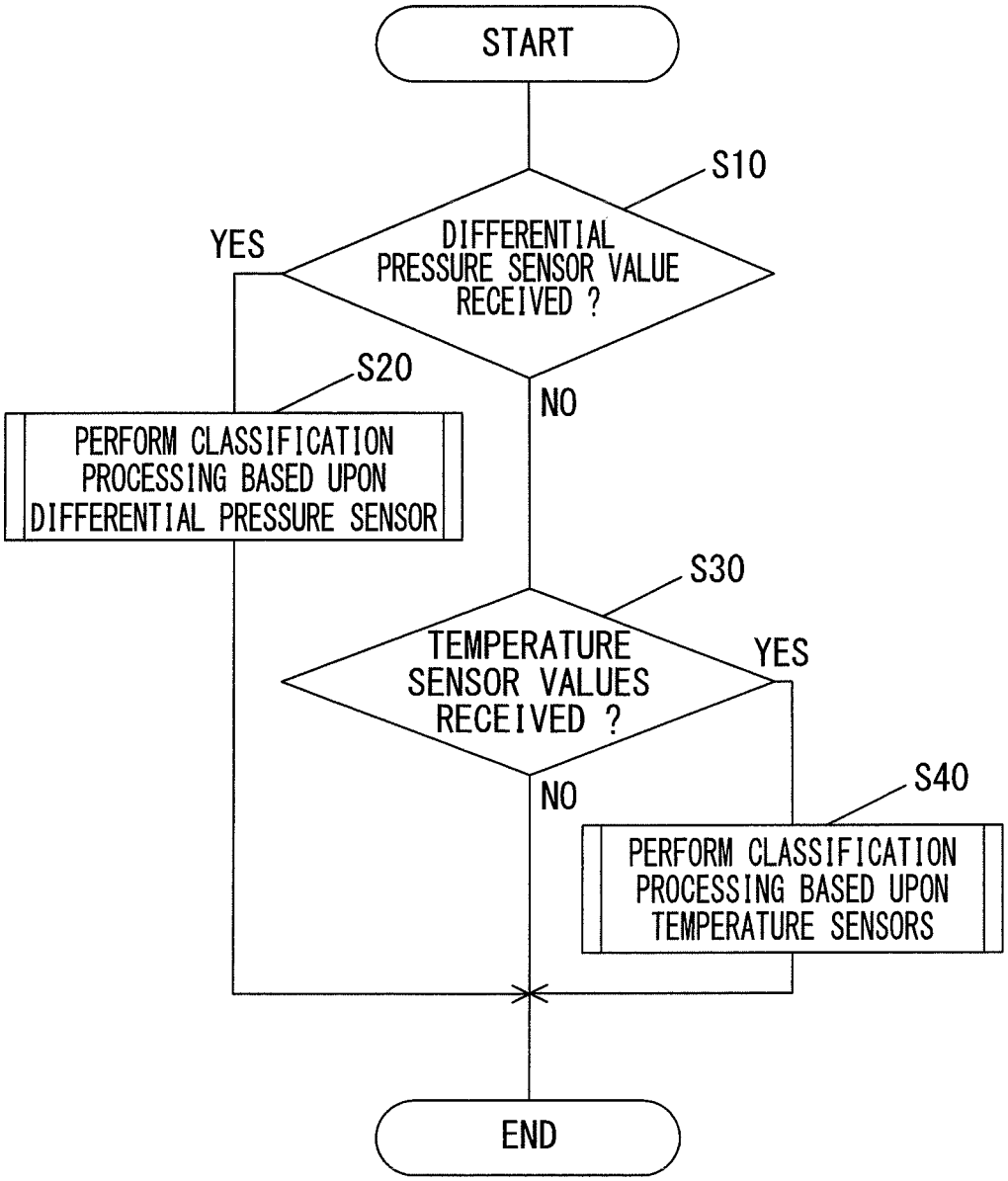
FIG. 10 is a flow chart of operating level classification processing for a hydraulic excavator performed by the base station.

FIG. 10 is a flow chart of operating level classification processing performed by the base station BC for the hydraulic excavators. The control device 34 of the base station BC executes this processing by reading in a control program that is stored in advance in a storage medium not shown in the figures (for example, in a ROM). And the control device 34 classifies the operating levels of the individual hydraulic excavators by repeatedly executing this processing shown in FIG. 10.

First in step S10 the control device 34 makes a decision as to whether or not sensor data of the DPF differential pressure sensor 15*d* has been received from a hydraulic excavator. If sensor data of the DPF differential pressure sensor 15*d* has been received, then the flow of control proceeds to step S20, and classification processing that will be described hereinafter based upon the differential pressure sensor is performed. On the other hand, if sensor data of the DPF differential pressure sensor 15*d* has not been received, then the flow of control is transferred to step S30.

In this step S30, the control device 34 makes a decision as to whether or not sensor data from the temperature sensors such as the engine cooling water temperature sensor 15*w* and so on has been received from the hydraulic excavator. If sensor data from the temperature sensors has been received, then the flow of control proceeds to step S40, and classification processing that will be described hereinafter based upon the temperature sensors is performed. On the other hand, if sensor data for the temperature sensors has not been received, then the processing shown in FIG. 10 terminates.

Figure 11:
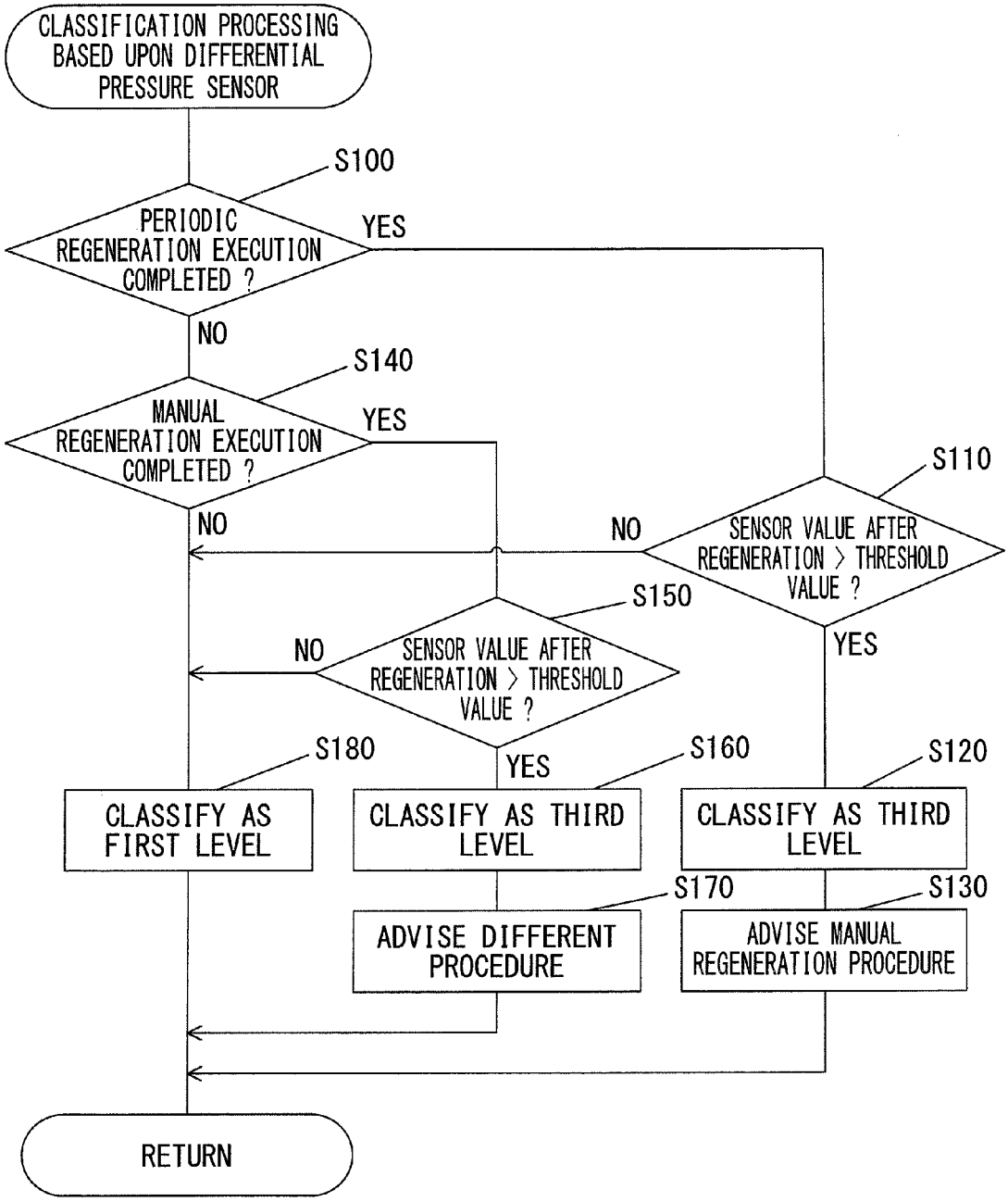
FIG. 11 is a flow chart of classification processing based upon a differential pressure sensor, called by step S20 of FIG. 10.

FIG. 11 is a flow chart of classification processing based upon the differential pressure sensor, called in step S20 of FIG. 10. This processing is processing that is included in the control program executed by the control device 34. In first step S100, the control device 34 makes a decision as to whether or not event data has been received indicating that execution of periodic regeneration control has been completed. If such event data has been received then the flow of control proceeds to step S110, in which a decision is made as to whether or not the sensor value when periodic regeneration control has been completed (i.e. the PM deposition amount) is greater than a predetermined threshold value. If the sensor value is greater than the predetermined threshold value, then the flow of control proceeds to step S120, in which this hydraulic excavator is classified as operating on the third level. And in the next step S130 the operator is advised, as a course of action, to perform the procedure of executing manual regeneration control. In other words, display data is transmitted to the management terminal TM indicating that this hydraulic excavator has been classified as operating on the third level, and advising the procedure described above. Upon receipt of this display data by the management terminal TM, the symbol 104 indicating the third level is displayed upon the map 101, and the procedure described above is displayed in response to selection actuation by the operator.

On the other hand, if in step S110 the sensor value is equal to or less than the predetermined threshold value, then the flow of control is transferred to step S180, in which the control device 34 classifies this hydraulic excavator as operating on the first level. And display data is transmitted to the management terminal TM indicating that this hydraulic excavator has been classified as operating on the first level.

But if in step S100 no event data has been received indicating that execution of periodic regeneration control has been completed, then the flow of control is transferred to step S140. And, in this step S140, the control device 34 makes a decision as to whether or not event data has been received indicating that execution of manual regeneration control has been completed. If such event data has not been received then the flow of control proceeds to step S180, in which the control device 34 classifies this hydraulic excavator as operating on the first level. And display data is transmitted to the management terminal TM indicating that this hydraulic excavator has been classified as operating on the first level. On the other hand, if execution of manual regeneration control has been completed, then the flow of control is transferred to step S150.

In this step S150, the control device 34 makes a decision as to whether or not the sensor value when manual regeneration control has been completed (i.e. the PM deposition amount) is greater than a predetermined threshold value. If the sensor value is greater than the predetermined threshold value, then the flow of control proceeds to step S160, in which this hydraulic excavator is classified as operating on the third level. And in the next step S170 the operator is advised, as a course of action, to perform a procedure that is different from executing manual regeneration control, such as inspection by service personnel or the like. In other words, display data is transmitted to the management terminal TM indicating that this hydraulic excavator has been classified as operating on the third level, and advising the procedure described above. Upon receipt of this display data by the management terminal TM, the symbol 104 indicating the third level is displayed upon the map 101, and the procedure described above is displayed in response to selection actuation by the operator. On the other hand, if in step S150 the sensor value is less than or equal to the predetermined threshold value, then the flow of control is transferred to step S180, in which the control device 34 classifies this hydraulic excavator as operating on the first level. And display data indicating that this hydraulic excavator has been classified as operating on the first level is transmitted to the management terminal TM.

Figure 12:
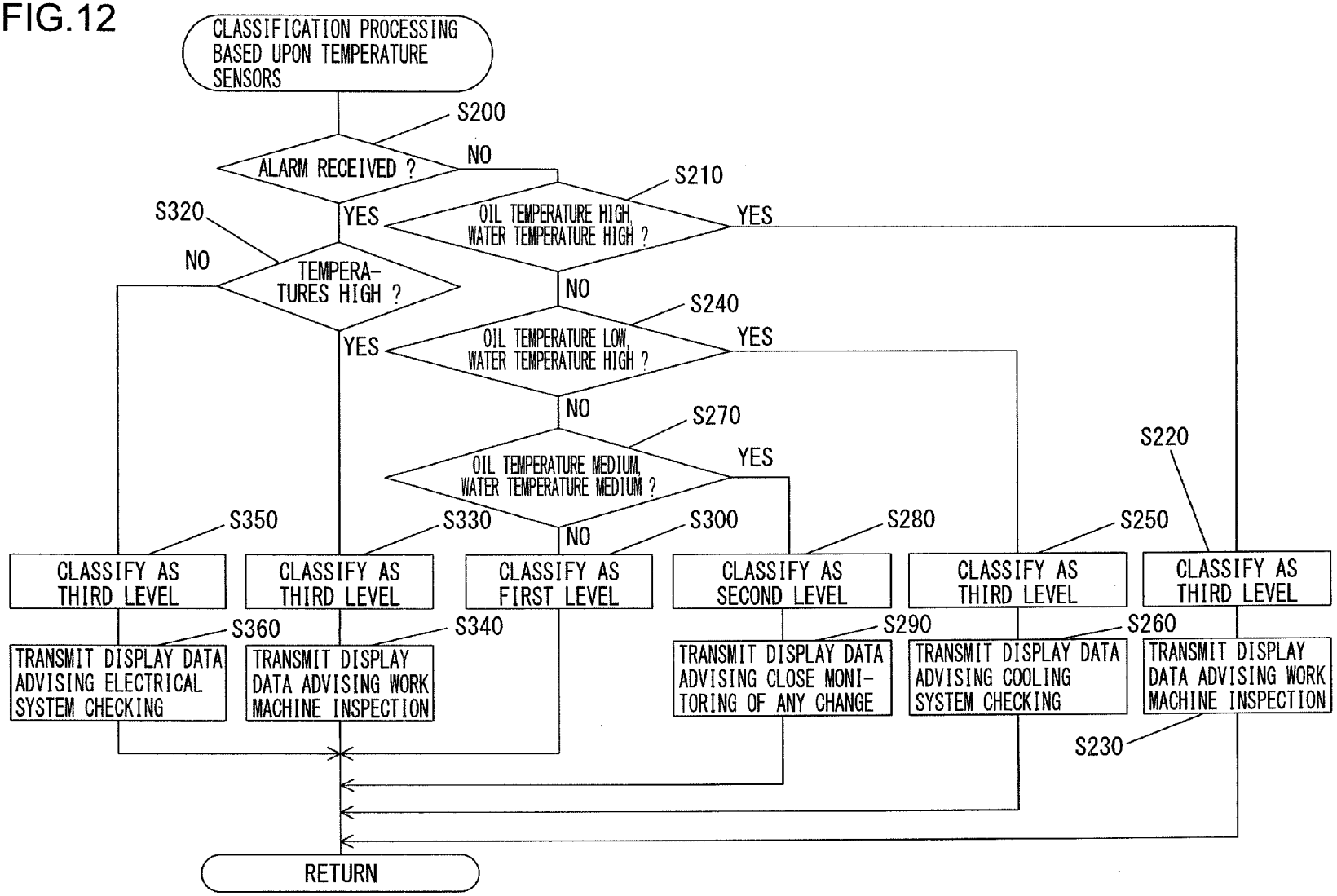
FIG. 12 is a flow chart of classification processing based upon temperature sensors, called by step S40 of FIG. 10.

FIG. 12 is a flow chart of classification processing based upon the temperature sensors, called in step S40 of FIG. 10. This processing is processing that is included in the control program executed by the control device 34. In a first step S200, the control device 34 makes a decision as to whether or not alarm data indicating an overheating warning has been received from the hydraulic excavator. If such alarm data has been received, then the flow of control is transferred to step S320, and a decision is made as to whether or not both the temperature of the engine cooling water and the temperature of the hydraulic oil are higher than the corresponding respective average temperatures by at least predetermined amounts. If these temperatures are higher than the average temperatures by at least the predetermined amounts, then the flow of control proceeds to step S330, in which this hydraulic excavator is classified as operating on the third level. And in the next step S340, as a course of action, a procedure such as inspection of the work machine by service personnel or the like is advised to the operator. In other words, display data is transmitted to the management terminal TM indicating that this hydraulic excavator has been classified as operating on the third level, and indicating the procedure described above. Upon receipt of this display data by the management terminal TM, the symbol 104 indicating operation on the third level is displayed upon the map 101, and the procedure described above is displayed in response to selection actuation by the operator.

On the other hand, if in step S320 both the temperature of the engine cooling water and also the temperature of the hydraulic oil are not higher than the corresponding respective average temperatures by at least the predetermined amounts, then the flow of control is transferred to step S350. In this step S350, the control device 34 classifies this hydraulic excavator as operating on the third level (the case 2-5 described above). And in the next step S360, as a course of action, the procedure of inspecting the electrical system or the like is advised to the operator. In other words, display data is transmitted to the management terminal TM indicating that this hydraulic excavator has been classified as operating on the third level, and indicating the procedure described above. Upon receipt of this display data by the management terminal TM, the symbol 104 indicating operation on the third level is displayed upon the map 101, and the procedure described above is displayed in response to selection actuation by the operator.

If in step S200 alarm data has not been received, then the flow of control proceeds to step S210. In this step S210, the control device 34 compares both the temperature of the hydraulic oil and the temperature of the engine cooling water with their respective average temperatures. And the differences between these two temperatures and their respective average values are calculated. If these two differences are equal to or greater than their respective second threshold values, then the flow of control proceeds from this step S210 to step S220. In this step S220, the control device 34 classifies this hydraulic excavator as operating on the third level (the case 2-3 described above). And in the next step S230, as a course of action, the procedure of inspection of the work machine by service personnel or the like is advised to the operator. In other words, display data is transmitted to the management terminal TM indicating that this hydraulic excavator has been classified as operating on the third level, and indicating the procedure described above.

But if a negative decision has been reached in step S210, then the flow of control is transferred to step S240. In this step S240, the control device 34 makes a decision as to whether or not the difference of the hydraulic oil temperature from its average value is less than the first threshold value, and moreover the difference of the cooling water temperature from its average value is equal to or greater than the second threshold value. If this condition is satisfied, the flow of control proceeds to step S250. In this step S250, the control device 34 classifies this hydraulic excavator as operating on the third level (the case 2-4 described above). And in the next step S260, as a course of action, the procedure of inspection of the cooling system or the like is advised to the operator. In other words, display data is transmitted to the management terminal TM indicating that this hydraulic excavator has been classified as operating on the third level, and indicating the procedure described above.

But if a negative decision has been reached in step S240, then the flow of control is transferred to step S270. In step S240, the control device 34 makes a decision as to whether or not the differences of the two temperatures described above from their average values are both greater than or equal to the first threshold value. If this condition is satisfied, then the flow of control proceeds to step S280. In this step S280, the control device 34 classifies this hydraulic excavator as operating on the second level (the case 2-2 described above). And in the next step S290, as a course of action, the operator is advised to monitor subsequent changes closely. In other words, display data is transmitted to the management terminal TM indicating that this hydraulic excavator has been classified as operating on the second level, and indicating the procedure described above.

If a negative decision is reached in step S270, then the flow of control is transferred to step S300. In this step S300, the control device 34 classifies this hydraulic excavator as operating on the first level (the case 2-1 described above).

The management system for a hydraulic excavator according to the first embodiment described above provides the following beneficial operational effects.

(1) The receiver 31 receives from a hydraulic excavator both the sensor data that indicates the states of various sections of the hydraulic excavator, and also the alarm data that indicates that the hydraulic excavator itself has decided that an abnormality has occurred with that hydraulic excavator. And, on the basis of the sensor data received by the receiver 31, the control device 34 classifies the operating state of the hydraulic excavator into four operating levels. Since these arrangements are provided, it is possible to prevent the occurrence of failures of the work machine even before they happen.

(2) On the basis of the operating level on which the operation of the hydraulic excavator has been classified, the control device 34 transmits to the management terminal TM, via the modem 33, display data including a course of action that is necessary in order to bring the operating state of the hydraulic excavator to the normal state, and thereby notifies this course of action to the operator of the management terminal TM. Due to implementation of these arrangements, the operator is able to select an appropriate course of action, without needing to rely upon his/her own capabilities or experience.

(3) The receiver 31 receives event data transmitted from the hydraulic excavator corresponding to the implementation of a course of action that has been notified. And, on the basis of the event data that has thus been received, the control device 34 re-classifies the operating state of this hydraulic excavator as being one of the four operating levels. Due to implementation of these arrangements, if the problem has not been eliminated by only the course of action that was notified, it becomes possible to advise the operator of the management terminal TM of a second and even a third course of action.

(4) For each of the operating levels on which the operation of the hydraulic excavator is classified, the control device 34 selects at least one from a plurality of courses of action, and notifies this course of action to the management terminal TM. To put this in another manner, even if the operating level is the same, depending upon the reason for classification at this operating level, different courses of action may be notified to the operator of the management terminal TM. Due to implementation of these arrangements, it is possible to handle a problem with the hydraulic excavator in a more appropriate manner, since it becomes possible to advise the operator of the optimum course of action in each case, even though the operating level is the same.

(5) The receiver 31 receives the current position of each of the hydraulic excavators. And, by transmitting display data to the management terminal TM via the modem 33, the control device 34, along with displaying the map 101 upon the display screen of the display device 44, also displays the symbols 103 through 106 that indicate the operating levels on which the operations of the hydraulic excavators have been classified, superimposed upon the map 101 in positions that correspond to the current positions of the hydraulic excavators as received by the receiver 31. Due to implementation of these arrangements, the operator of the management terminal TM is able to ascertain the operating positions of the hydraulic excavators in a simple and easy manner.

Variations such as described in the following also fall within the range of the present invention, and each of these variant embodiments may be employed either individually or in combination with another one thereof, or more.

(Variant Embodiment #1)

In the embodiment described above, it would also be acceptable to arrange for the base station BC to perform classification of the operating levels on the basis of the type of engine with which each of the hydraulic excavators is equipped, or the like. This is because work machines to which engines of different types are mounted transmit state data of different types. Moreover since there is also a possibility that, for example, the value "100" may denote sensor values of different amounts, or the like, so that, even though the state data is the same, sometimes its meaning may be different, accordingly it is desirable to change the method of classification for each type of engine in consideration of this type of factor.

(Variant Embodiment #2)

It would also be acceptable to arrange for the base station BC to classify the operating level on the basis of past state data. For example if, for some hydraulic excavator, the cooling water temperature has been gradually rising during the past one week, and the most recent cooling water temperature also is on this rising line, then it is considered that this change of temperature is due to some long term change (for example, clogging of the filter or the like). On the other hand, if the cooling water temperature has abruptly risen from the temperatures on previous days, then the possibility is high that, for example, an abnormality has occurred with the engine cooling water temperature sensor 15*w*. Thus the base station BC advises the operator to perform procedures for different countermeasures in the former case and in the latter case. By using state data that has been accumulated in the past for classification of the operating level in this manner, it becomes possible to advise the operator to perform procedures for more accurate countermeasures.

(Variant Embodiment #3)

After the operator of the management terminal TM is advised of a countermeasure procedure, it would also be possible to arrange for the base station BC to transmit control signals of some type to the hydraulic excavator via a transmission unit such as the modem or the like, according to actuation from the operator of the management terminal TM. For example, a limit may be imposed so that the operator of the hydraulic excavator does not arbitrarily perform manual regeneration control, since that would be undesirable. In other words, normally it may be arranged for regeneration control not to be performed, even though actuation such as depression of the manual regeneration button or the like is performed. And, if a hydraulic excavator is classified as operating on the third level, and the handling procedure of executing manual regeneration control has been advised to the operator of the management terminal TM, then a preparatory operation signal is transmitted from the base station BC to that hydraulic excavator according to actuation by the operator upon the management terminal TM. Upon receipt of this preparatory operation signal, the hydraulic excavator performs preparation for manual regeneration control. In concrete terms, the limitation upon execution of manual regeneration control is removed, so that a situation is established in which execution of manual regeneration control is possible. Thereafter, the controller 20 of the hydraulic excavator is caused to execute manual regeneration control by the operator of the hydraulic shovel depressing the manual regeneration button.

(Variant Embodiment #4)

It would be acceptable to arrange for a plurality of courses of action to be displayed simultaneously upon the management terminal TM, if abnormalities occur simultaneously in a large number of sections of a hydraulic excavator. Alternatively, it would also be acceptable to arrange to select one of this plurality of courses of action for display on the basis of a predetermined priority order. It should be understood that, if abnormalities have occurred at a plurality of sections, then classification of the operating level is performed individually for each of the sections on the basis of the situation there, and the operating level that is the highest (i.e. that is the worst) is employed as the operating level for this hydraulic excavator. For example, if the classification based upon the regeneration mechanism for the DPF is the third level while the classification based upon the cooling system for the engine is the second level, then it is displayed upon the management terminal TM that the operating level of this hydraulic excavator is the third level.

(Variant Embodiment #5)

While, in the embodiment described above, an example was explained in which the operating level of the hydraulic excavator was classified according to the state of regeneration of the DPF and the state of the cooling system of the engine, the present invention is not to be considered as being limited to this type of embodiment. It would also be possible to apply the present invention to cases in which the states of parameters of other types are detected. Moreover, the present invention can be applied, not only to the case of a management device for hydraulic excavators, but also to the case of a management device that manages work machines of other types.

(Variant Embodiment #6)

While, in the embodiments described above, the management terminal TM and the base station BC were described as being separate devices, it would also be acceptable to arrange for them to be a single combined device.

The present invention is not to be considered as being limited by the embodiments described above; provided that the essential characteristics of the present invention are not departed from, other embodiments that are considered to come within the range of the technical concept of the present invention are also considered to fall within the scope of the present invention.

The content of the disclosure of the following application, upon which priority is claimed, is hereby incorporated herein by reference:

Japanese Patent Application No. 2012-102849 (filed on Apr. 27, 2012).

The invention claimed is:

1. A work machine management device, comprising:

a receiving unit that receives, from a work machine, sensor data indicating states of various sections of the work machine, and alarm data indicating that the work machine has determined that an abnormality has occurred in the work machine;

an operating level classifying unit that, based on the sensor data received by the receiving unit, classifies an operating state of the work machine as being any one of a plurality of predetermined operating levels;

a position receiving unit that receives a current position of the work machine; and a display unit that displays a map upon a display screen, and also displays a symbol indicating the operating level of the work machine as classified by the operating level classifying unit, superimposed upon the map at a position within the display screen that corresponds to the current position of the work machine as received by the position receiving unit.

2. A work machine management device according to claim 1, further comprising:

a notification unit that, based on an operating level of the work machine as classified by the operating level classifying unit, notifies an operator of a course of action that is needed for bringing the operating state of the work machine to a normal state.

3. A work machine management device according to claim 2, further comprising:

a transmission unit that transmits, to the work machine, a preparatory operation signal for causing the work machine to perform preparatory operation corresponding to the course of action notified by the notification unit.

4. A work machine management device according to claim 3, further comprising:

an event receiving unit that receives event data transmitted from the work machine in response to the course of action that has been implemented; wherein based on the event data received by the event receiving unit, the operating level classifying unit reclassifies the operating state of the work machine as being any one of the plurality of operating levels.

5. A work machine management device according to claim 4, wherein:

for each operating level of the work machine as classified by the operating level classification unit, the notification unit selects at least one of a plurality of courses of action, and notifies the operator thereof.

6. A work machine management device according to claim 3, wherein:

for each operating level of the work machine as classified by the operating level classification unit, the notification unit selects at least one of a plurality of courses of action, and notifies the operator thereof.

7. A work machine management device according to claim 2, further comprising:

an event receiving unit that receives event data transmitted from the work machine in response to the course of action that has been implemented; wherein based on the event data received by the event receiving unit, the operating level classifying unit reclassifies the operating state of the work machine as being any one of the plurality of operating levels.

8. A work machine management device according to claim 7, wherein:

for each operating level of the work machine as classified by the operating level classification unit, the notification unit selects at least one of a plurality of courses of action, and notifies the operator thereof.

9. A work machine management device according to claim 2, wherein:

for each operating level of the work machine as classified by the operating level classification unit, the notification unit selects at least one of a plurality of courses of action, and notifies the operator thereof.

10. A work machine management device, comprising:

a receiving unit that receives, from a work machine, sensor data indicating states of various sections of the work machine, and alarm data indicating that the work machine has determined that an abnormality has occurred in the work machine; and an operating level classifying unit that, based on the sensor data received by the receiving unit, classifies an operating state of the work machine as being any one of a plurality of predetermined operating levels;

a notification unit that, based on an operating level of the work machine as classified by the operating level classifying unit, notifies an operator of a course of action that is needed for bringing the operating state of the work machine to a normal state; and a transmission unit that transmits, to the work machine, a preparatory operation signal for causing the work machine to perform preparatory operation corresponding to the course of action notified by the notification unit.

* * * * *